US009289675B2

(12) United States Patent
Wollo et al.

(10) Patent No.: US 9,289,675 B2
(45) Date of Patent: Mar. 22, 2016

(54) FLEXOR WITH EXTENDING FLEXOR ARM

(75) Inventors: Even Wollo, Naersnes (NO); Thomas Holm, Oslo (NO); Oyvar Svendsen, Oslo (NO)

(73) Assignee: Rottefella AS, Klokkarstua (NO)

( * ) Notice: Subject to any disclaimer, the term of this patent is extended or adjusted under 35 U.S.C. 154(b) by 0 days.

(21) Appl. No.: 13/384,402

(22) PCT Filed: Jul. 17, 2009

(86) PCT No.: PCT/EP2009/059209

§ 371 (c)(1), (2), (4) Date: Apr. 2, 2012

(87) PCT Pub. No.: WO2011/006542

PCT Pub. Date: Jan. 20, 2011

(65) Prior Publication Data

US 2012/0187643 A1 Jul. 26, 2012

(51) Int. Cl.
*A63C 9/20* (2012.01)

(52) U.S. Cl.
CPC ..... *A63C 9/20* (2013.01)

(58) Field of Classification Search
CPC ..... A63C 9/086; A63C 9/16; A63C 9/18; A63C 9/20
USPC ..... 280/11.31, 614, 615
See application file for complete search history.

(56) References Cited

U.S. PATENT DOCUMENTS 4,659,103 A * 4/1987 Tessaro ..... 280/615
4,907,817 A * 3/1990 Schwarz ..... 280/615
4,927,168 A * 5/1990 Provence et al. ..... 280/615
5,085,454 A * 2/1992 Provence et al. ..... 280/615
5,108,125 A * 4/1992 Callegari ..... 280/615
5,228,714 A 7/1993 Dekanovsky (Continued)

FOREIGN PATENT DOCUMENTS

CN 1713937 12/2005
CN 101115535 A 1/2008

(Continued)

OTHER PUBLICATIONS

International Search Report for corresponding patent application No. PCT/EP2009/059209 dated Apr. 29, 2010.

(Continued)

*Primary Examiner* — Frank Vanaman
(74) *Attorney, Agent, or Firm* — Renner, Otto, Boisselle & Sklar, LLP

(57) ABSTRACT

A flexor for use in a ski binding or mounting plate for a cross country or touring ski, comprises an extending flexor arm and a holding and positioning portion, wherein the extending flexor arm is connectable to, or integral with, the holding and positioning portion such that the extending flexor arm can rotate and/or displace with respect to the holding and positioning portion around the point of connection between the two. The extending flexor arm is formed such that the amount of displacement of the extending flexor arm as a result of an applied force acting thereon follows a substantially linear relationship, up to a first desired amount of displacement. For a displacement of the extending flexor arm greater than the first desired amount of displacement, the amount of displacement of the extending flexor arm as a result of an applied force acting thereon follows an approximately exponential relationship.

17 Claims, 6 Drawing Sheets

(56) References Cited

U.S. PATENT DOCUMENTS

| | | | | |
|---|---|---|---|---|
| 6,402,184 | B1 * | 6/2002 | Hauglin | 280/615 |
| 2003/0127833 | A1 * | 7/2003 | Lancon et al. | 280/615 |
| 2006/0006019 | A1 | 1/2006 | Caserta et al. | |
| 2007/0114762 | A1 * | 5/2007 | Rival et al. | 280/615 |
| 2013/0249192 | A1 | 9/2013 | Bjertnaes | |

FOREIGN PATENT DOCUMENTS

| | | | |
|---|---|---|---|
| CN | 101185807 | A | 5/2008 |
| EP | 2 116 286 | | 11/2009 |
| RU | 60379 | U1 | 1/2007 |
| WO | 87/06486 | | 11/1987 |
| WO | 95/32773 | | 12/1995 |
| WO | 2006082483 | A1 | 8/2006 |

OTHER PUBLICATIONS

Chinese Office Action for corresponding Chinese patent application No. 200980160488.1 dated Oct. 24, 2013.

* cited by examiner

FLEXOR WITH EXTENDING FLEXOR ARM

This application is a national phase of International Application No. PCT/EP2009/059209 filed Jul. 17, 2009 and published in the English language.

BACKGROUND TO THE INVENTION

In cross country or touring skiing, the ski boot of the skier is typically attached in a rotatable manner to the ski. Often the ski boot will be provided with a pin, or the like, at the front portion thereof, which fits in an appropriately shaped housing section on the binding or mounting plate attached to the ski. The action of cross country skiing involves the skier removing the heel section of the boot from the top surface of the ski whilst performing the walking type manoeuvre. In order to increase the effectiveness of cross country skiing, it is common to provide some sort of restorative flexor in the region of the toe portion of the ski boot. This flexor acts to counter the rotation of the ski boot where the heel leaves the top surface of the ski, such that the heel of the ski boot will tend to be pushed back into contact with the top surface of the ski.

Numerous prior art flexors have been proposed, the most simple being a compression flexor formed by some elastic-type material. This sort of flexor fits in front of the toe portion of the boot of the skier, and will simply be compressed when the skier rotates the ski boot and brings the heel of this boot off the top surface of the ski. Looking at FIG. 6*a*, a graph is provided showing the force versus the displacement curves for a variety of possible flexors. As shown in this diagram, the amount of force required (shown in the Y-axis) is depicted for a certain degree of rotation of the ski boot. The graph shown by the dotted line, describes the case of a fully compression-type flexor. As can be seen from this graph, an approximately exponential relationship starting from no rotation to a maximum rotation is obtained, which is understandable as clearly a compressed flexor can only be compressed so far. Further, the act of compressing the flexor will lead to increasing forces required for the same compression amount, thus giving the approximately exponential curve. The values shown for each curve in FIG. 6*a* are generally accepted values, and are indeed preferred values insofar as they relate to the flexor of the present disclosure, as detailed below. These values are not, however, considered to be a fully restrictive disclosure, and indeed equally useful characteristics for a flexor can be obtained with values lying anywhere between 30% either side of these given examples.

A second curve is given, formed by the dot-dash line, which comprises essentially two straight lines for the force versus displacement curve. In this case, a spring-type element is attached to a rigid flexor, and this spring resists the rotation of the ski boot. Most springs act in a linear manner in this way, thus leading to an approximately linear force versus displacement section to the graph. Clearly, once the spring has reached its maximum compression or the rotatable flexor arm has reached the point where its lower surface is in contact with the mounting plate or ski binding, a discontinuity in the linear curve is generated. At this point, the only further possibility is some degree of compression of either the toe in the ski boot, the compression of the flexor itself or some degree of deformation of the flexor and ski binding. This leads to a very steep gradient in the force versus displacement curve, and is essentially a result of the flexor arm being unable to rotate further because of the binding or the like.

In each of these cases, drawbacks exist. For example, in the simple compression flexor, it is quite clear that the maximum rotation is limited by the literal maximum amount of compression that the flexor can accommodate. This is rarely reached, however, as the skier is then providing a large force on the flexor in order to obtain the desired rotation and compression, which will become extremely painful after a short time. In reality, the maximum amount of boot rotation which can be achieved by means of a simple compression flexor, is between 20° and 25°. In order to increase the amount of rotation of the boot, the flexor must be structured such that it can be compressed to a greater degree. In order to achieve this, however, the return force generated by the flexor will generally be reduced at lower rotation angles, which is undesirable from the point of the skier.

With regard to the spring option, whilst this gives a tuneable force versus displacement curve in the linear portion, the sudden discontinuity is a jarring force felt by the skier, in particular in their toes, which is uncomfortable and undesirable for the skier. Additionally, the lack of feedback at the high rotation angles of the ski boot, i.e. the fact that the high rotation angles do not give rise to high resistive forces, leads to the skier feeling disconnected from the ski and snow. This lack of connection is quite disorienting for skiers used to such feedback, and is an undesirable aspect which needs considering.

It is most desirable to have a combination of these two curves, wherein the first section of the force versus rotation curve is a generally linear curve, and wherein the amount of return force for a certain boot rotation can be tailored. Once a chosen maximum rotation has been obtained, it is further desirable to avoid a sudden discontinuity, and give a smooth transition into an exponential type of force versus displacement curve.

The advantages associated with this sort of force versus displacement curve relate to being able to accommodate a much larger rotation angle of the boot with regard to the ski. In particular, a larger rotation angle of the boot will allow the skier to make a longer stride, thus improving the technique and efficiency of the skiing action. Additionally, this longer stride can be undertaken without fear of digging the nose of the ski into the snow. As the larger rotation angle is not associated with a larger force applied through the boot by the skier onto the ski, there is no chance of the nose of the ski being forced into the snow. A further advantageous aspect, is that the skier still feels well connected with the ski and snow, which is a result of the final higher return force acting on the boot at the high end rotation point. Finally, as the force being applied to the ski boot will generally be lower, the skier will not suffer excessive force on the toes, which will tend to reduce any bruising which is typical for long periods of cross country skiing.

SUMMARY OF THE INVENTION

In order to address the abovementioned problems, the present disclosure relates to a flexor, and ski binding therefor, which exhibits a linear force versus displacement curve up until a first desirable point, and for additional rotation of the ski boot, provides a smooth transition into a more exponential force versus displacement curve. According to one aspect of the present disclosure, a flexor is provided which is suitable for combination and use with a mounting plate or ski binding, in particular for a cross country or touring ski. The flexor in this case is provided with an extension or arm which is generally attached or forms an integral part of the rest of the flexor. The remaining section of the flexor is structured so as to attach or be attachable to the extension arm, or of course integral with, and may be used for attaching the flexor within an appropriate housing on the ski binding or mounting plate.

In particular, the extending arm is attached or an integral part of the flexor, but can rotate and/or displace with respect to the remaining holding and positioning section of the flexor. This rotation and/or displacement is generally centred on, or around, the point of connection between the flexor arm and holding portion.

Primarily, the flexor arm is structured such that the rotation and/or displacement thereof will follow an approximately linear relationship with regard to the required level of force. This may be achieved in a variety of different ways, although by forming the flexor arm as an integral part of the flexor itself, it is clear that rotation of the extending arm will lead to a compression and stretching of sections of the flexor, which will lead to an approximately linear force versus displacement curve. By specifically tuning the shape of the flexor, and in particular the extension, it is possible to allow for the transition point between the linear force versus displacement curve to an approximately exponential curve, to be preset. For example, this could be achieved by tailoring the remaining section of the flexor so that only a certain amount of displacement or rotation of the extending arm can occur prior to the extending arm striking a further part of the flexor. Obviously, at this point the flexor will require compression in order to allow further rotation of a ski boot, which will then lead to the exponential type curve from this certain rotation or displacement point. Finally, it is also clear that a ski binding could be so structured that after a certain degree of rotation, the extending arm strikes the top of the ski binding or mounting plate thus leading to the compression characteristics in the force versus displacement curve.

As will be clear, however, it is also possible to tune the transfer between the linear to exponential sections of the curve by choice of material. As is described above, the rotation and displacement of the flexor arm will lead to a stretching and compression of the material thereabout. In particular, the stretching and compression occurs around the lower section of the flexor arm at the point where it contacts, or is integral with, the remaining part of the flexor. Clearly this stretching and compression will eventually dominate the force versus displacement curve, which will lead to the exponential curve at higher rotation angles.

In particular, it is advantageous if the flexor, or simply merely the extending flexor arm, is made from a material which is generally elastic. That is, that the material can be elastically bent and/or compressed but that the material will maintain the memory of the original shape, and return thereto after removal of any force. As would be clear from this, the linear force versus displacement section to the curve would relate to a rotation of the extension arm, as described above, and the exponential section to the curve would relate to a compression of the extension arm, and also to a degree sections of the flexor in the region of the point of connection. Further, this may relate only to the compression and stretching of the flexor and flexor arm around the point of contact between these two, without the need for the flexor arm to strike a further surface and be compressed. Obviously, as only parts of the flexor are being rotated and compressed and stretched, the operation is more energy efficient. That is, there is less energy being lost to heat from excessive compression of the flexor, as only a section thereof is undergoing deformation. One could consider that as the flexor arm is rotating, the action is somewhat spring-like, as the return force is essentially the springing back into shape of the flexor, thus leading to a better energy characteristic with less losses.

In order to provide a flexor which is also useful for a skating technique for cross country skiing, a rear section can also be provided. This rear section would extend opposite, or approximately so, from the direction of the extension arm. In so doing, it is clear that this would lie generally underneath the ski boot, and thus provide the restorative force and a cushion against the lower surface of the ski boot, when the skier is performing a skating-type of skiing action.

Within such a structured flexor, it is possible to provide a slot or indent which can be used to receive the rotation pin of a ski boot when attached to a ski binding. If the ski boot is positioned with its rotation pin in such a slot or indent, the ski boot itself will help to keep the flexor attached to the ski binding when the boot is attached. This is particularly advantageous, as it will most likely stop the flexor from becoming disconnected with the mounting plate or ski binding when in use. If the flexor is provided with a rear extending portion, the slot is most advantageously positioned between the extension flexor arm and this rear portion. If the flexor does not comprise a rear portion, the slot is best positioned such that the boot is attached to the ski binding and when the pin is within this slot, the front extension or flexor arm rests on the front surface of the ski boot.

Additionally, the slot in the flexor for accommodating the pin of the ski boot could be somewhat closed over. This closing could be provided by making the slot generally circular in cross section, with one or two extensions over the top of the slot with a gap there-between. This gap would allow the pin of the boot to pass there-through, by virtue of the flexible nature of the flexor, and as a result of the fact that the covering flaps would be quite thin and flexible themselves. This would lead to a slot into which the rotation pin of the ski boot would need to be forced, and would then tend to grip the pin. Not only would these ensure a good solid connection between the flexor and the ski boot, it would mean that the slot would tend not to fill up with snow prior to the boot being engaged therewith. Clearly, if the ski is standing without being connected to the ski boot the slot is open, should it also be snowing at this time, the slot will tend to fill up with snow making it difficult to affix the ski boot thereto.

In order to allow for a solid attachment of the flexor to the ski binding, the lower section of the flexor can be provided with one or more feet-like extensions. These extensions or feet will thus provide a solid base upon which the flexor can rest, and may also be used to position within slots or flanges provided on a ski binding. Further, the angle between the lower surface of the flexor extension and the upper surface of the front foot, will lead to a maximum rotation of the extension arm, and thus can be used to specifically tailor the transition point in the force versus displacement curve.

If the thickness of the extension arm is varied, the required amount of force for a certain amount of displacement can also be tailored. Clearly, the thicker the extending arm the more force is required to lead to the same degree of rotation.

Whilst it is possible to form the flexor from a single material, thus allowing simple extrusion of a flexor in which the cross section is as desired, and numerous flexors may simply be cut from this extrusion, it is also possible to provide the flexor from multiple materials. For example, the upper surface of the extension arm could be provided with a low friction and highly resilient coating or material layer, so as to improve the lifetime of the flexor.

Another option for increasing the connectability of the flexor and the mounting plate or ski binding, is to provide the flexor with some protrusions therein. For example, the flexor could be possessed of a small hole in an appropriate section thereof, into which a metal pin or bar is positioned. This metal pin or bar would thus provide protrusions either side of the flexor, wherein these protrusions could be used to interact with appropriate slots on the ski binding or mounting plate.

One other aspect which can be introduced into the flexor, is that the lower surface does not form a flat layer. That is, the feet extensions do not provide a horizontal flat base to the flexor. In this case, when the flexor is to be attached within the ski binding, it must be to a degree stressed in order to ensure that the base makes flat contact with the upper surface of the ski, the ski binding or the mounting plate. This requirement of a pre-stress may be useful if the skier prefers a particularly resilient flexor when skiing. Additionally, this will help to improve the removal of the ski boot from the ski binding, as the flexor will generally push up against the pin of the ski boot thus facilitating removal from the flexor.

As has been stated above, it is also possible to provide the extending flexor arm by means of a rotatable member attached to the remaining section of the flexor. In this case, the rotating extension arm could be held by means of a torsion spring, thus leading to an approximately linear force versus displacement curve. By integrating a compression section, perhaps a piece of elastic material underneath the rotating extension arm, at a desired amount of rotation, the extension arm could make contact with the compression section, and thus the remaining force versus displacement curve would be dominated by these compression characteristics. This would lead to a generally exponential force versus displacement graph, from this desired point.

If the flexor is combined with a ski binding, obviously the ski binding is comprised of a variety of features to improve the connectability of the flexor therewith. For example, certain fixing means or mechanisms would be integrated with the ski binding or mounting plate to allow these to interact with the lower or holding section of the flexor.

The housing section on the ski binding would advantageously be provided with a series of slots or flanges, under which sections of the flexor could be placed. For example, one or more slots or flanges positioned at appropriate sections of the ski binding could interact with the feet of the flexor, should these be provided, and thus improve the connectability and hold the flexor at the desired portion of the binding.

It would be further advantageous if the ski binding were to have ski boot holding portions, and for the flexor to be positioned with its slot therein aligned with the holding portion for the ski boot on the binding. By positioning the flexor such that the slot therein aligns with the holding portion for the rotation pin of the ski boot, the alignment of the flexor, ski binding and ski boot can be improved.

Structuring the flexor with a shaped recess on the underside thereof, primarily in the base, allows this to interact with a similarly shaped protrusion in the ski binding or mounting plate. As will be clear, when the flexor is positioned within the ski binding and in use, significant longitudinal forces will act on the flexor tending to try and move the flexor in the direction of skiing. By positioning a protrusion on the ski binding or mounting plate, and a similarly sized and shaped indent on the flexor, the effects of these longitudinal forces can be significantly reduced.

Finally, if the flexor is provided with protrusions to aid the mounting within a ski binding or mounting plate, the binding or mounting plate can be provided with an appropriate slot for receiving these protrusions. This will improve the connectability between the flexor and the ski binding, and tend to reduce the chances of the two being separated in use.

As will be clear from the above, the force versus displacement curves for the amount of rotation and displacement of the flexor arm can be varied by adjusting the size and thickness of the various sections of the flexor and flexor arm. It is also possible, and advantageous from a commercial point of view, to change the force versus displacement curves by means of changing the material of the flexor only. That is, a range of identically shaped flexors can be produced, but from different materials with different hardness characteristics. This allows a single machine to extrude the same shaped flexor each time, with the resulting force versus displacement characteristics being determined by choice of material only.

One final consideration is that in general the skier will only be able to apply a certain force to the flexor before it either hurts too much, or the maximum rotation has been reached. As will be abundantly clear from the curves in FIG. 6, the option of the flexor which has a linear force versus displacement section leading into the exponential section is desirable, as for a certain applied force the maximum rotation of the ski boot is greatly increased. That is, the skier will be able to rotate the ski boot to a much larger rotation angle for the same applied force, which not only increases the efficiency of the skiing action, but also reduces the stress on the skier as the action may still be improved with greater rotation angles, without the use of such a high force.

DETAILED DESCRIPTION

Figure 1A:
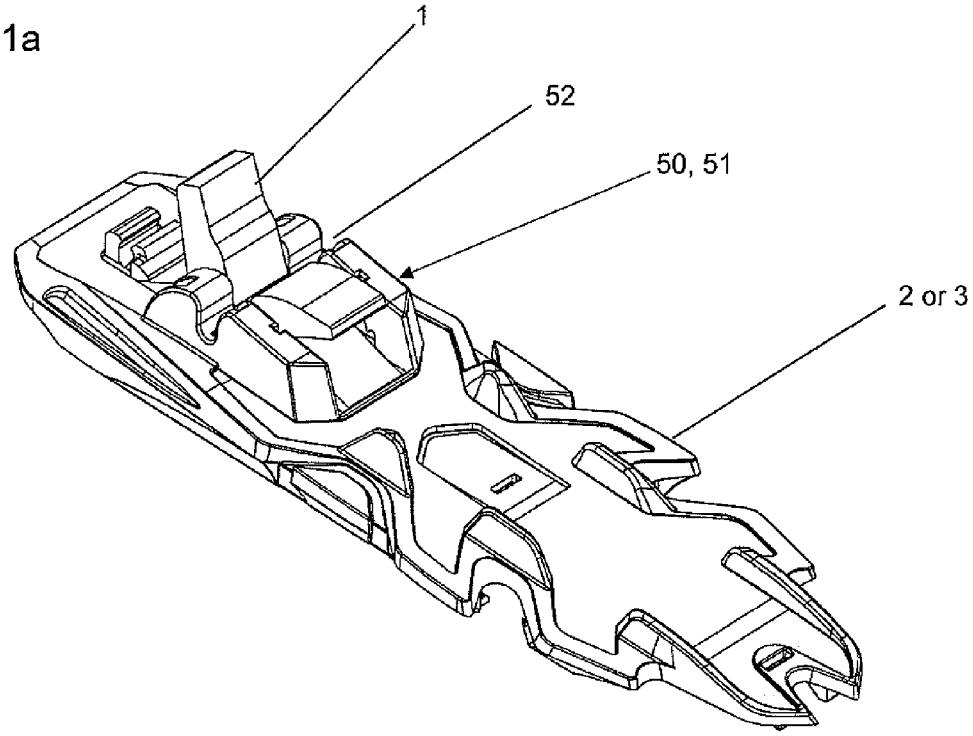
FIGS. 1*a* and 1*b* are perspective and cross sectional views of a ski binding comprising the flexor of the present disclosure.

Looking at FIG. 1*a*, a ski binding 2 incorporating the flexor 1 of the current disclosure is shown in perspective form. As can be seen from the Figure, the flexor 1 is intended to be positioned within the binding 2 in the region surrounding the attachment of a ski boot 7 to the binding 2. Whilst FIG. 1*a* shows the flexor 1 integrated with a ski binding 2, it is also conceivable for the flexor 1 to be incorporated with a mounting plate 3 for a ski-4. The ski binding 2 and mounting plate 3 as well as the flexor 1, are intended for use with cross country or touring skis-4. In cross country or touring skiing the skier is attached to the ski 4—in a rotatable manner. In order to allow for appropriate skiing action, it is necessary for the ski boot 7 to be fixed to the ski-4, usually by means of the binding 2 or mounting plate 31 and to be able to rotate around the toe portion of the ski boot 7.

As has been discussed above, rotation of the ski boot 7 during skiing is typically performed around the toe portion of the ski boot 7. During the skiing, the heel of the ski boot 7 leaves the top surface of the ski-4, to allow the skier to move forward. In order to promote appropriate skiing action, same mechanism is provided within the ski binding 2 or mounting plate 3 which generally acts to rotate the ski boot 7 such that its heel is brought back into contact with the upper surface of the ski-4. In the main, this rotation is provided by means of a flexor 1.

Figure 1B:
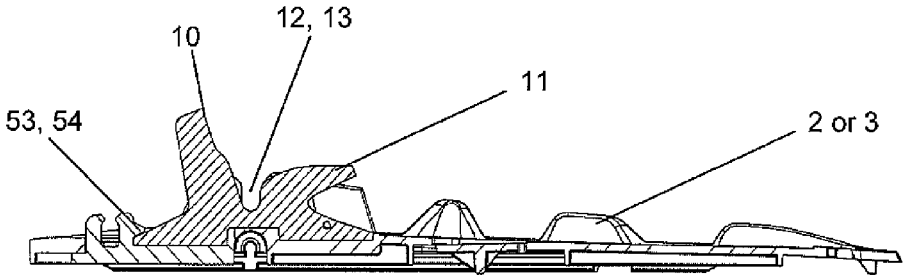

As can be seen in FIG. 1*b*, which is a cross sectional view along the central longitudinal axis of the ski binding 2 shown in FIG. 1*a*, the flexor 1 is provided with an extension or extending flexor arm 10. This extending flexor arm 10 is positioned forward of the binding point of the ski boot 7 with the ski binding 2, and thus will interact with the toe portion of the ski boot 7. As is well known in the art, ski boots 7 are generally provided with a rotation pin 6, which is held in the ski binding 2 in a rotational manner. During skiing, the ski boot 7 rotates around the rotation pin 6, such that the toe of the ski boot 7 is rotated toward the top surface of the ski 4—thus bringing the heel of the ski boot 7 from out of contact with the ski-4.

Figure 2A:
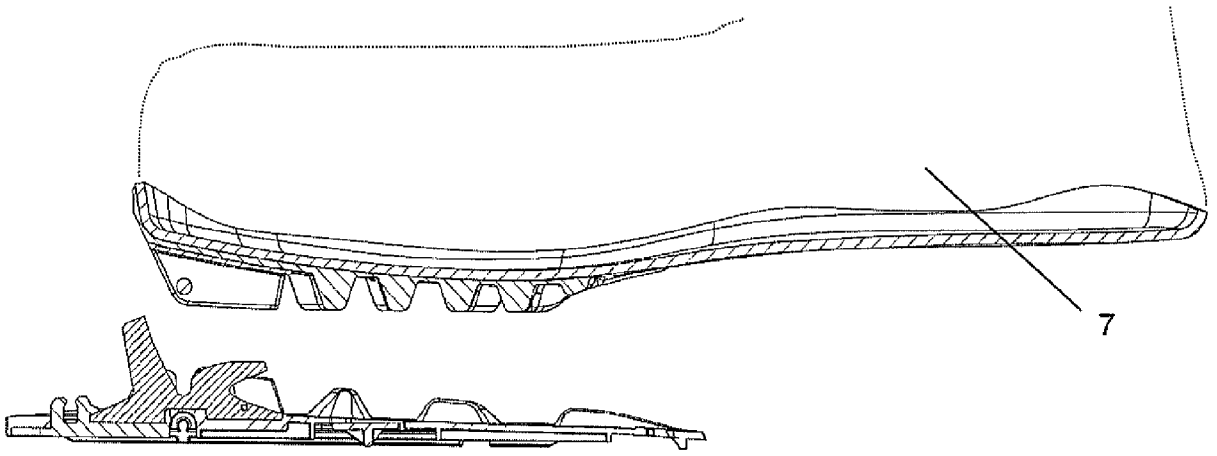
FIGS. 2*a*, 2*b* and 2*c* show a series of images indicating how the ski boot of a skier interacts with the mounting plate and flexor.
Figure 2B:
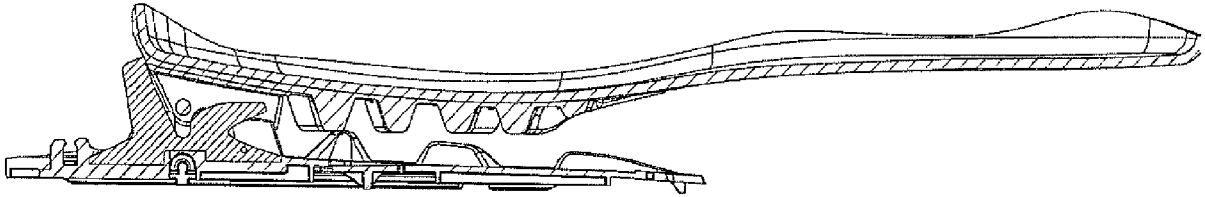
Figure 2C:
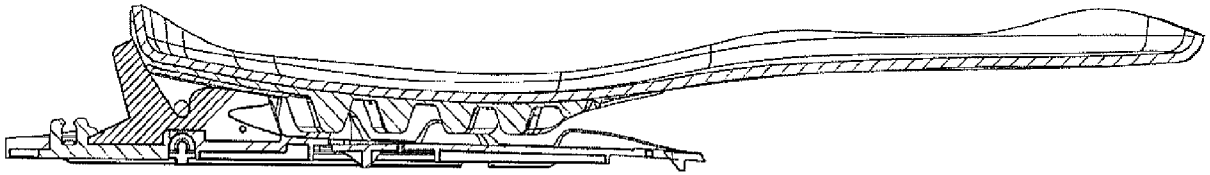

Looking at FIG. 2, one can see the cross sectional view shown in FIG. 1*b* and the interaction of the sole or lower part of the ski boot 7 therewith. In particular, it is clear that when bringing the ski boot 7 into mating arrangement with the ski binding 2 (please note that FIG. 2 does not show the means of fixing the ski boot 7 to the ski binding 2) the toe portion of the ski boot 7 is brought into contact with the extending flexor arm 10 of the flexor 1.

In the present disclosure, the flexor 1 operates by deforming during use of the ski-4. In particular, the extending flexor arm 10 will be rotated by the force acting from the toe of the ski boot 7 acting thereupon. As is clear, the greater the force acting from the ski boot 7 the larger the rotation of the extending flexor arm 10 away from its rest position.

As the flexor 1 is provided from a material which can be elastically deformed, it is clear that the rotation of the extending flexor arm 10 will cause a resistive and opposing force to be generated, countering the rotation as a result of the force from the ski boot 7. When the ski boot 7 stops acting upon the extending flexor arm 10, the flexor 1 will attempt to regain its normal shape, and thus will act against the ski boot 7 to rotate this back into contact with the top surface of the ski-4. In this manner, it is clear that the flexor 1 as shown in FIGS. 1 and 2 will, by means of the elastic deformation of the flexor 1 and the rotation of the extending flexor arm 10, act to return the ski boot 7 into contact with the ski-4.

As will be understood from viewing the flexor 1 as shown in the Figures, for a first amount of deformation of the extending flexor arm 10, the extending flexor arm 10 primarily rotates around its attachment region to the remaining portion of the flexor. The remaining portion of the flexor 1 will be discussed below, and is primarily a holding and positioning portion 20 designed to allow the flexor 1 to be held and positioned appropriately within the ski binding 2 or mounting plate 3.

As will understood, the rotation of the extending flexor arm 10 is primarily around the point of connection 21 between the extending flexor arm 10 and the holding and positioning portion 20. During the rotation of the extending flexor arm 10, it is clear that certain portions of the extending flexor arm 10 will undergo a rotation and stretching action, and additionally other sections will be compressed as well as being rotated. In the main, however, the response force generated by this rotation of the extending flexor arm 10 will be substantially linear. In other words, for rotation of the extending flexor arm 10 from its position of rest until the lower surface is brought into contact with either a further section of the flexor 1 or the upper surface of the ski binding 2 or mounting plate 3, the amount of displacement of the extending flexor arm 10 varies substantially linearly with the applied force from the toe of the ski boot 7. Of course, for certain choices of material for the flexor (1), as well as shapes and thicknesses of the extending flexor arm (10), the exponential section (32) to the force versus displacement curve will result from the compression and stretching of the area around the point of connection (21). These characteristics will tend to dominate the linear relationship (30), thus giving the desired shape to the graph. As will discussed in further detail below, the gradient of the force versus displacement curve can be varied by varying the shape and other aspects of the flexor 1, and in particular the extending flexor arm 10.

Once the lower surface of the extending flexor arm 10 has been brought into contact with the upper surface of the ski binding 2 or another section of the flexor 1, it is clear that the extending flexor arm 10 cannot rotate any further. At this point, the extending flexor arm 10 will be compressed during further rotation of the ski boot 7, and in particular by the toe portion thereof. As the flexor 1 is made from a substantially elastic type material, the compression of the extending flexor arm 10 is possible, but it is clear that in general this will generate a far greater resistive force to the rotation of the ski boot 7. Indeed, the force versus displacement curve during compression of the extending flexor arm 10 will tend to have an exponential type curve when the extending flexor arm 10 is being compressed.

The above description is to a degree a simplification of what is occurring within the flexor 1, and has been given for clearer understanding. In truth, it is expected that the transference from a linear force versus displacement curve to an exponential force versus displacement curve will not occur at the precise moment the extending flexor arm 10 has reached maximum rotation. Indeed, it is expected that for high degrees of rotation of the extending flexor arm 10 a change in the force versus displacement curve will arise, leading this away from the linear relationship. As can be understood from the above, as the extending flexor arm 10 reaches a high rotation amount, which can be tailored by choice of flexor 1 shape and in particular the extending flexor arm 10 thickness, the upper and lower sections of the extending flexor arm 10 will be stretched and compressed respectively, and as this increases, the force versus displacement curve will tend to shift to a more exponential type relationship. Further, the angle between the extending flexor arm 10 and the holding and positioning portion 20 can be either by means of a rounded bend, or a straight-sided bend, as desired. The rounded bend will tend to lead to a further resistance to rotation of the extending flexor arm 10, as this will provide a thicker section at the point of contact 21 between the extending flexor arm 10 and the flexor 1.

As will be discussed further below, by tailoring the shape of the flexor 1, and in particular the thickness of the extending flexor arm 10, the onset of the exponential force versus rotation amount of the ski boot 7 can be to a degree tailored. As will be understood, a thin extending flexor arm 10 will tend to have a linear force versus displacement curve until it is in fact in contact with either the ski binding 2 or another section of the flexor 1, thus stopping any further rotation. By having a thicker extending flexor arm 10, it is clear that prior to the flexor arm 10 making contact with the ski binding 2 or other portion of the flexor 1, the sheer thickness of the extending flexor arm 10 will lead to the non-linear force versus displacement relationship. By adjusting these parameters, it is clear that a flexor 1 can be designed such that the desired maximum degree of boot 7 rotation for a linear return force can be generated.

As well as providing the above flexor 1 design, it is possible to also tailor this response by means of a plurality of springs acting on a rotationally held extending flexor arm 10. By fastening the extending flexor arm 10 to a torsion spring, it is clear that the torsion spring will provide an approximately linear force versus displacement curve opposing the rotation of the extending flexor arm 10. If the flexor 1 were also provided with a compression portion 5 which could be tailored to interact with the extending flexor arm 10 after a certain degree of rotation, this compression portion 5 would lead to the exponential force versus displacement curve, as this would tend to dominate the force versus displacement curve over the effects of the torsion spring. For example, the compression portion 5 could be a piece of elastic-type material, for example rubber or the like, which is positioned under the extending flexor arm 10. When the extending flexor arm 10 has rotated by a certain desired amount, its lower surface contacts this compression portion 5, and can only proceed by compression of the compression portion 5. This will once again lead to the general curve as shown in the above single unit flexor 1 operating from the elastic material in general.

Returning to the flexor 1 shown in the Figures, it is clear that the holding and positioning portion 20 is structured so as to improve connection of the flexor 1 to the ski binding 2. In particular, the holding and positioning portion 20 may be provided with feet-like extensions 22, whilst two are shown in the Figure also one is possible or indeed more than one. The feet-like extensions 22 will provide a base 23 which can be used to rest the flexor 1 upon. With the flexor 1 resting on the base 23 it is possible to use the feet-like extensions 22 to interact with appropriate structures on a ski binding 2 or mounting plate 3. In particular, the feet-like extensions 22 could be provided in slots or flanges on a ski binding 2 or mounting plate 3, thus holding the flexor 1 in position. As is further possible, the flexor 1 could be held within a ski binding 2 or mounting plate 3 by passing the flexor 1 through an appropriately shaped orifice in the ski binding 2 or mounting plate 3 from beneath. The orifice would thus be appropriately shaped to interact with the feet-like extensions 22, thus holding the flexor 1 in position. Alternatively, the ski binding 2 or mounting plate 3 could have appropriate slots, flanges or lips 53 in the upper surface thereof, under which the feet-like extensions 22 may be positioned. This would then appropriately hold the flexor 1 in the correct position on the ski binding 2 or mounting plate 3.

Advantageously, the flexor 1 could be integrated in some manner with the mounting portion for the ski boot 7. As has been discussed above, the ski boot 7 is generally mounted to the ski binding 2 by means of a rotation pin 6. A variety of known mechanisms for attaching the ski boot 7 are known, and it is contended that the flexor 1 could be readily adapted to interact therewith.

As is seen in the Figures, the flexor 1 may advantageously be provided with a pin receiving section 12 therein. This pin receiving section 12 is primarily structured as a slot 13, and is approximately the same size and shape as the rotation pin 6 of a ski boot 7. When the flexor 1 is held in a ski binding 2, the pin receiving section 12 is adapted to align with the pin attachment section 52 in the shoe attachment means 51 of the ski binding 2. This can be clearly seen in FIGS. 2*a* to 2*c*, in which the slot 13 of the flexor 1 is located at the point where the rotation pin 6 of the ski boot 7 interacts with the pin holding section 52 of the ski binding 2. By structuring a slot 13 in the flexor 1, it is further possible to hold the flexor 1 within the ski binding 2 by means of the ski boot 7 itself. As is clear from FIGS. 2*a* to 2*c*, the flexor 1 will not readily come out of the ski binding 2 when the ski boot 7 is connected therewith, as the rotation pin 6 is held within the slot 13 thus holding the flexor 1 in engagement with the ski binding 2.

It is further possible to provide some form of extension or protrusion in the flexor 1. This is not shown in any of the Figures. For example, a protrusion, perhaps by means of a pin passing through the flexor 1 from one side to another, could be used to also hold the flexor 1 within the ski binding 2. By having an appropriately positioned holding slot 54 within the ski binding 2, upon attachment of the flexor 1 with the ski binding 21 the protrusion could interact with this holding slot 54. This will provide a second point of contact holding the flexor 1 within the ski binding 2.

As is evident from each of the Figures, a further advantageous aspect of the flexor 1 is the optional provision of a recess 26 in the base 23. Providing a rectangular structured slot, or indeed any cross sectional shaped slot or recess 26 in the base 231 allows for a longitudinal positioning of the flexor 1 with respect to the ski binding 2. It is clear that if the ski binding 2 or mounting plate 3 is provided with a matching binding protrusion or step 55 at the appropriate position, the flexor 1 will be further held within the ski binding 2. In particular, during use of the ski-4, the flexor 1 will be put under significant forward and backward motion strain as the skier move the ski-4 forward and backward. By providing a recess 26 and protrusion 55 in the flexor 1 and ski binding 2 or mounting plate 31 the flexor 1 can be more stably held within the binding 2 or mounting plate 3. That is, the interaction of the protrusion 55 and the recess 26 would generally act to stop the longitudinal motion of the flexor 1 when the ski-4 is in use.

Another aspect of the flexor 1 which can be seen in the Figures, is the optional provision of the rear support portion 11. The extending flexor arm 10 is particularly advantageous for standard cross country or touring skiing. It is also possible to perform a skating action with a cross country or touring ski-4, and in order to allow appropriate motion of the ski 4-*a* rear support portion 11 may be provided. This rear support portion 11 extends in the opposite direction from the extending flexor arm 10, and will generally extend toward the rear portion of the ski-4.

Looking at FIG. 2, it is clear that the rear support portion 11 will be positioned underneath the front portion of the ski boot 7, and will provide a resistance to the pushing down of the ski boot 7 onto the upper surface of the ski-4. This action is undertaken when a cross country or touring ski 4—is being used in a skate-type action, and will allow the ski 4—to slightly push away from the lower surface of the ski boot 7 during this skating action. As will be appreciated from the Figures and in consideration of the location of the rear support portion 11, this will typically be provided at a lower angle with respect to the holding and positioning portion 20 of the flexor 1 than the corresponding angle made by the extending flexor arm 10.

It is equally possible to provide the flexor 1 without this rear support portion 11, thus somewhat simplifying the design of the flexor 1. If the flexor 1 comprises both the extending flexor arm 10 and the rear support portion 11, it is advantageous to position the pin receiving section 12, formed by slot 13, there-between. By structuring the flexor 1 in this way, the front portion of the ski boot 7 will automatically be brought into contact with the upper facing surface of the extending flexor arm 10. Additionally, the rear support portion 11 will be appropriately located underneath the ski boot 7, thus allowing appropriate skating action.

Whilst it is possible to provide the flexor 1 from a single piece of material, it is also possible to provide the flexor 1 from a combination of two different materials. Turning to the single material option for the flexor 1, this is advantageous as clearly the flexor 1 could be extruded in the appropriate shape out of the elastic material.

The extrusion would have the appropriate cross section of the flexor 1 as seen in the majority of the Figures, and could then simply be cut from this extruded piece. This leads to a very simple mechanism for producing the flexor 1, thus dramatically reducing manufacturing overhead.

Obviously if the flexor 1 is made from a single material, the characteristics will be determined solely by this lone material. It may be advantageous, however, to provide the upper surface of the flexor 1 with a different material with certain more advantageous properties. For example, as shown in FIG. 3, the upper surface of the flexor 1, this also includes the extending flexor arm 10 and rear support portion 11 if present, could be provided with a second material. This second material could be chosen to be a much harder and more wear resistant material, such that the interaction of the ski boot 7 with this upper surface does not lead to a rapid degradation of the flexor 1. By providing a thin upper surface of this second material, the properties of the flexor 1 will be primarily determined by the material chosen for the main body of the flexor 1, but the upper surface can be tailored to have better wear resistant properties. Further, if the material on the extending flexor arm (10) is also provided with a low coefficient of friction, there will tend to be less energy loss to such frictional forces when in use.

FIG. 3 shows several options for this combination of materials, and indeed also shows the possibility of having a two-piece flexor 1 in which the rear support portion 11 is provided from a separate piece from the extending flexor arm 10 and holding and positioning portion 20. What is also advantageous, is that this two piece flexor could be formed in a co-extrusion, wherein the material with higher wear characteristics is provided at the outside of the flexor. This co-extrusion will allow for a single formation step, and also a single machine, for production of the flexor. Additionally, it is possible to utilise a material which can be formed as a combination of two other composites, which after setting will provide a material which could be moulded into a flexor 1.

Figure 3C:
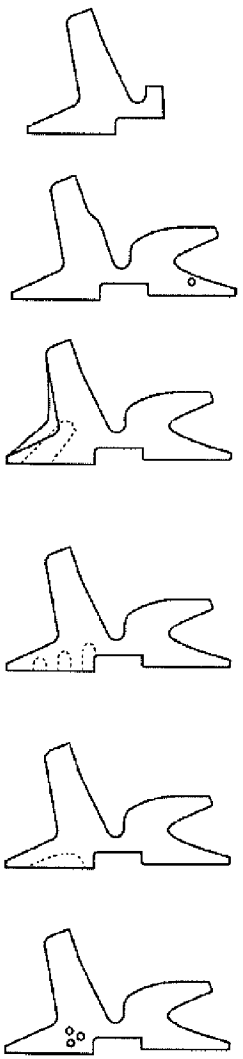
FIGS. 3*a*, 3*b* and 3*c* show a variety of possible design options for the flexor.
Figure 3B:
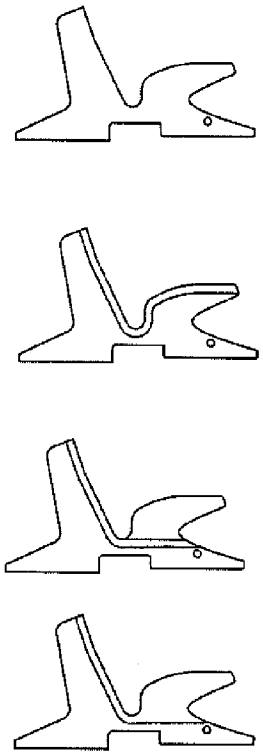
Figure 3A:
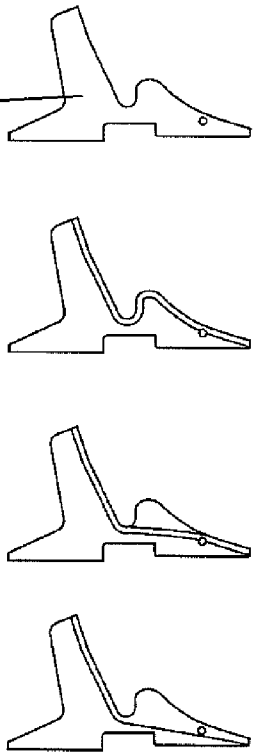

As shown in FIG. 3*a*, the options defined in FIG. 3*b* are equally applicable to a flexor 1 in which no rear support portion 11 has been provided. Once again, without the rear support portion 11, a slot 13 may be provided in the flexor 1 such that the flexor 1 will advantageously be held in the ski binding 2 by means of the rotation pin 6 of the ski boot 7. As is shown in each of FIGS. 3*a* and 3*b*, it is possible to provide the flexor 1 from a single material. Additionally, the entire top surface of the flexor 1 could be provided by a second material which has significantly different properties, primarily those of wear, hardness and friction. If is further possible to provide the flexor 1 as a multi-piece construction in which a second material passes through a section of the flexor 1, perhaps separating a rear section (such as the rear support portion 11 if provided) from the remaining body of the flexor 1. Also, it could be possible and desirable to provide a second material which also incorporates the rear support portion 11, such that this has different characteristics from the main material making up the flexor 1.

Indeed, it is further possible to actually utilise a multi-material flexor 1 in which the two or more materials are chosen for their memory effects. For example, the flexor 1 could be structured such that on the outer surface the flexor 1 the material is chosen to be rigid with a generally poor memory. This would allow for a greater resistance force to the deformation of the flexor 1, and also improve the wear. Incorporating a softer more flexible material with a good shape memory as a core to the flexor 1, would then allow for the flexor 1 to overcome the negative shape memory effects of the outer surface.

FIG. 3*c* shows a variety of further structures which could be incorporated within the flexor 1. The structure shown with dotted lines are hidden features within the body of the flexor 1. In each of these cases, by removing material from the flexor 1, the force versus displacement curve is affected. As will be understood from the above description, when the extending flexor arm 10 rotates, it leads to some degree of compression in the point of connection 21 and holding and positioning portion 20 region. By removing material from the flexor 1, the force versus displacement curve can be tailored and the point at which the exponential type of relationship begins can also be changed. Clearly, by removing more material it will be easier to rotate the extending flexor arm 10, and further the onset of the approximately exponential force versus relationship curve will be postponed to a higher degree of displacement of the extending flexor arm 10.

Figure 4:
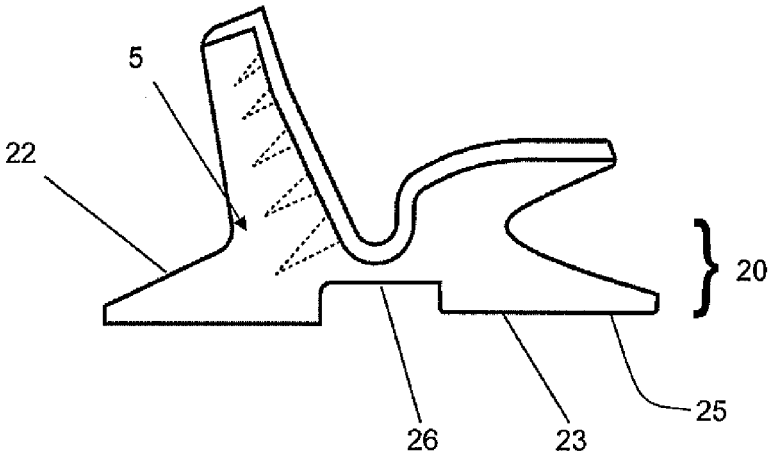
FIG. 4 is a cross sectional view of a flexor showing additional structure improving connectability between multiple portions of the flexor.

Turning to FIG. 4, a further adaptation for improving the combination of two materials in the flexor 1 is shown. If a second surface material is provided on the flexor 1, it must be connected by some means to the remaining flexor 1. For example, the upper material could be heat welded, or stuck by means of an appropriate adhesive to the upper surface of the flexor 1. In particular, this will be the upper surface of the extending flexor arm 10 and rear support portion 11. As can be seen in FIG. 4, if the upper surface of the extending flexor arm 10 (and of course the rear support portion 11 and so forth, although not shown in the Figure) is provided with an increased surface area, the skilled person will be well aware that the force of connection between the two materials will be greatly increased. In one example, it will be clear that more adhesive can be positioned between the two materials, thus leading to a stronger and more satisfactory connection between the two.

Figure 5:
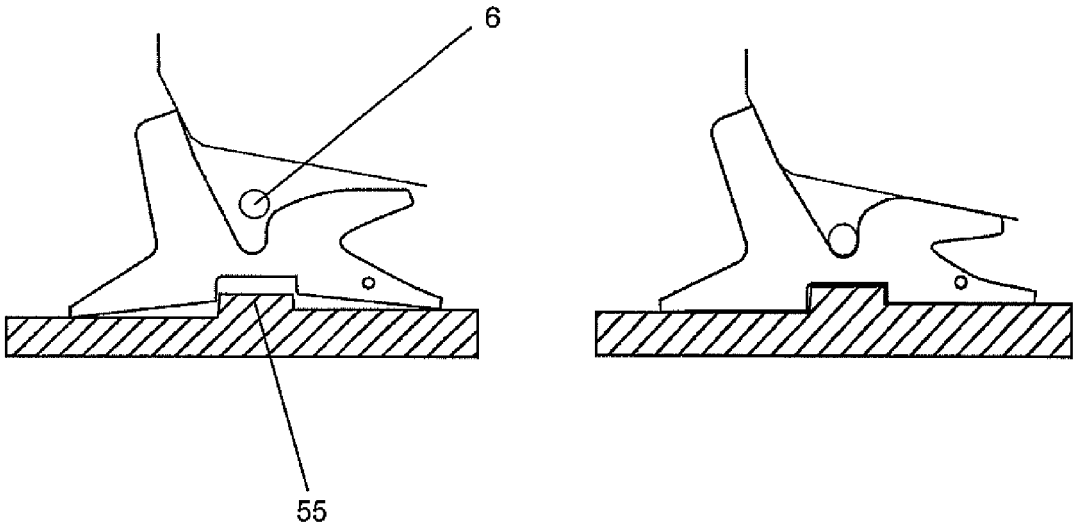
FIG. 5 illustrates the effects of having a flexor in which the base is not horizontal.

One further option for the flexor 1 is shown in FIG. 5. This Figure shows the interaction of the flexor 1 with the ski binding 2 as well as the ski boot 7. As is clear from this, the lower surface of the base 25 is not provided by a flat surface, rather the flexor 1 is to a degree bent. The front and back portions of the feet-like extensions 22 will naturally rest on the lower surface, but the middle portion of the base 23 is raised somewhat. Firstly, this is advantageous in that it will aid removal of the ski boot 7 from the ski binding 2, as naturally the flexor 1 will move slightly with the ski boot 7 upon removal, and will tend to open the slot 13 allowing easier removal of the rotation pin 6. A further advantage of this structure, is that the flexor 1 will be under stress even when the ski boot 7 is at rest. That is, when the ski boot 7 is attached to the ski binding 2, the flexor 1 will already be under some stress, which will lead to perhaps a harder characteristic to the flexor 1.

This pre-flexing or tensioning or stressing of the flexor 1 can also be achieved without providing the non-flat base 23 to the flexor 1. Obviously by providing the extending flexor arm 10 at an angle which does not match the angle of the toe of the ski boot 7, the extending flexor arm 10 will be put under rotational stress by attachment of the ski boot 7. As we have highlighted above, this option could be entertained for people who require a particularly strong resistive force to the rotation of the ski boot 7 in the binding 2.

Figure 6:
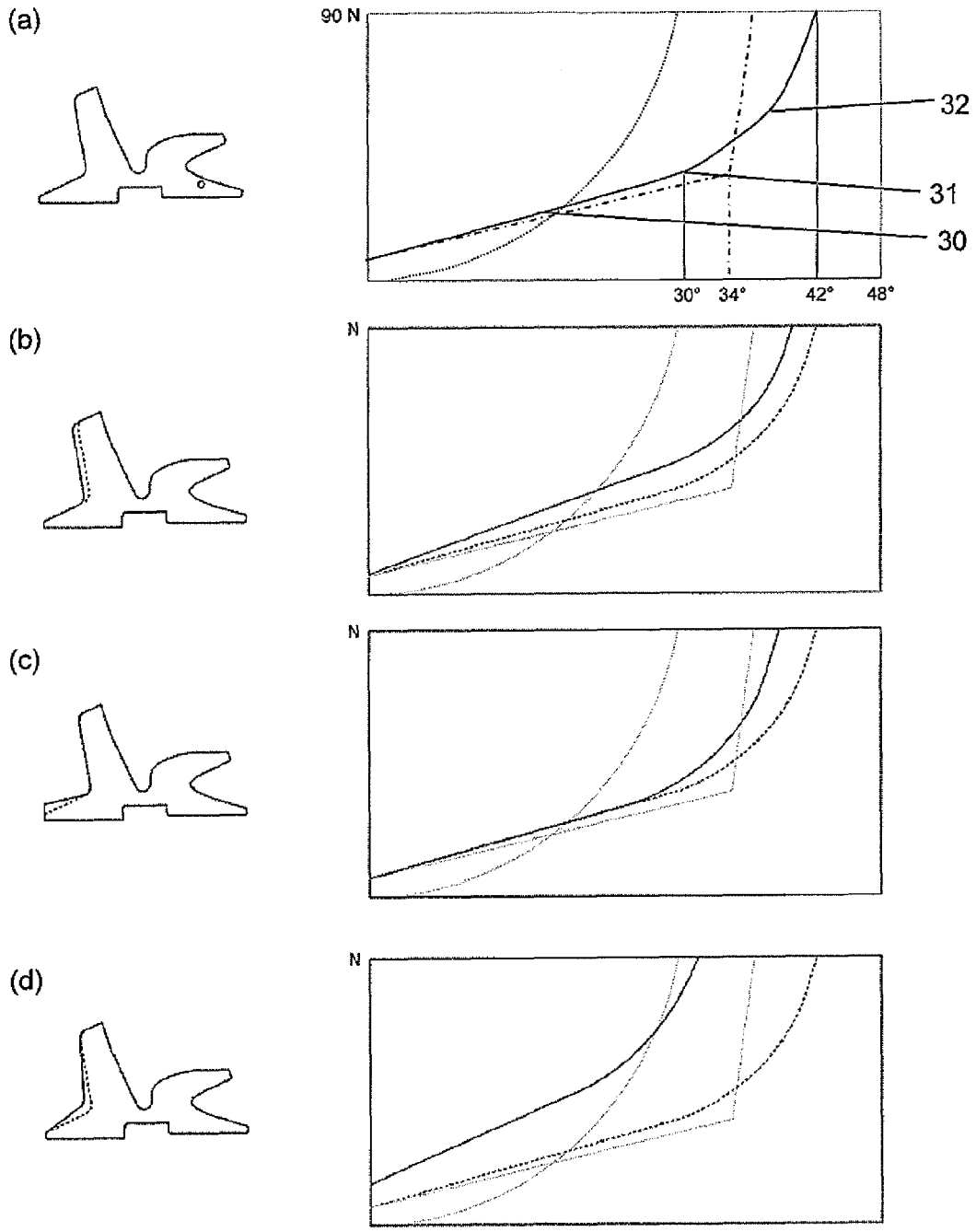
FIGS. 6(*a*)-(*d*) are force versus displacement curves for a variety of options for the shapes of flexor, wherein the solid line refers to the solid image of the flexor and the dotted line refers to the dotted image of the flexor.

As can be seen in FIG. 6, different designs for the front foot-like extension 22 and extending flexor arm 10 are shown with their respective force versus displacement curves. As is clear from this Figure, if the extending flexor arm 10 is increased in thickness, this will tend to give the force versus displacement curve a steeper gradient in the linear section. Quite simply, the thicker the extending flexor arm, the more force is required to rotate it. This is further due to the thicker point of connection region 21. The two curves in the graph show the comparison between the thicker and thinner extending flexor arms 10. Further, it is possible to increase the angle between the extending flexor arm 10 and the upper surface of the front foot-like extension 22. In changing this angle, the linear section of the force versus displacement curve is primarily unaffected, but the onset of the compression exponential section to the curve is postponed to a later amount of displacement of the extending flexor arm 10. In other words, the extending flexor arm 10 can be rotated further before its lower surface strikes the upper surface of the front foot-like extension 22. In this case, it is clear that the compression part of the force versus displacement curve will be at a higher degree of displacement.

By thickening the region of the point of connection 21, the two effects as described above can also be achieved. That is, the gradient for the linear section of the force versus displacement curve will be substantially increased, as it will be much harder to rotate the extending flexor arm 10. Further, as more material in the region of the point of connection 21 is present, the exponential type curve will onset at a lower displacement, as clearly a great deal more material of the flexor 1 will be present and need to be compressed during displacement of the extended flexor arm 10.

As can be seen in the graphs of FIG. 6, the linear relationship 30 is shown in each case. The point where the transition occurs to the approximately exponential relationship 32 has been highlighted as the desired amount of displacement 31. From the discussion above in relation to FIGS. 3 to 6, it is clear that the exact form of the curve can be clearly tailored in a variety of different ways. That is, by providing a different thickness to the extending flexor arm 10, or increasing the angle between the lower surface of the extending flexor arm 10 and the upper surface of the front foot-like extension 22, by increasing the thickness of the point of connection 21, and the like.

Figure 7:
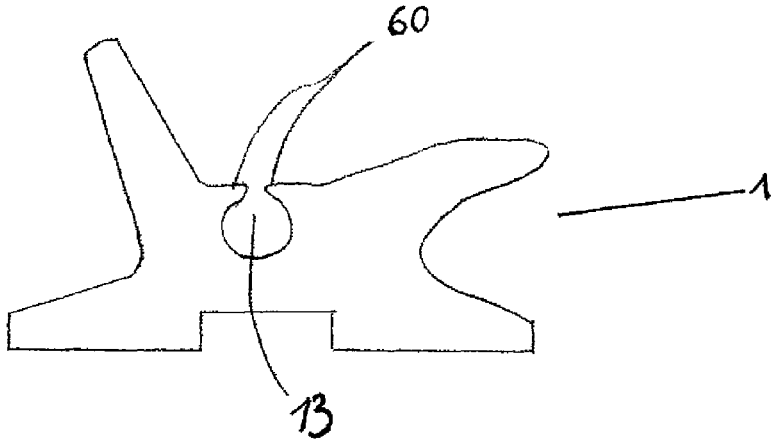
FIG. 7 shows a flexor design in which a slot for receiving the rotation pin of a ski boot is covered by opposed flaps.

FIG. 7 shows a further design for a flexor 1, in which the slot 13 is provided with a near closed upper opening. The slot 13 can be seen as having a near circular cross section, which is partly covered at the top by means of two opposed flaps 60. These flaps 60 can be deformed when the rotation pin 6 of the ski boot 7 is positioned and forced there-between, thus allowing the rotation pin 6 into the slot 13. This is advantageous as it gives the skier a good feeling of being well connected to the flexor 1 and ski-4, as well as actually reducing the chances of the rotation pin 6 coming out from the slot 13. Finally the two flaps 60 will tend to stop any snow which could be falling from entering the slot 13, thus improving the ease and speed with which the skier can engage with the flexor 1 and ski-4.

As is clear from the above, a new flexor 1 has been described with a variety of different options. It is not intended that any specific combination of these features is a required design parameter, and indeed as will be clear from at least the drawings of FIGS. 3, 5 and 6, a wide variety of options and design changes can be undertaken without departing from the underlying principle of the flexor 1.

Whilst the above discussion has centred on the use of the flexor 1 for positioning in the toe region of the ski boot 7, this is not intended as a limitation. It is conceivable to for the rotation pin 6 on the ski boot 7 to be located at a position which is under the ball of the skier's foot, rather than very close to the toes. Indeed, it is even conceivable to position the rotation pin 6 of the ski boot 7 at any point under the ski boot 7, which also includes the heel of the ski boot 7. In such cases, the flexor 1 of the current disclosure may still be used, but obviously needs to be slightly amended.

Figure 8:
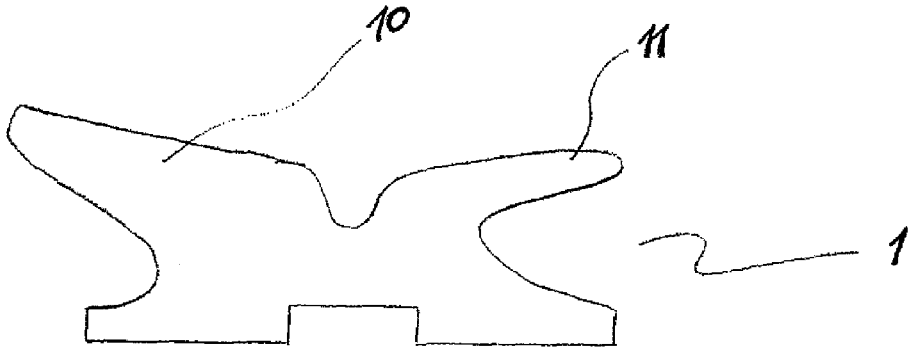
FIG. 8 shows a flexor design suitable for positioning under the ball of a foot, or other position under the boot of a skier.

In use, a flexor 1 which is for use under the ball of the foot, or at the heel of the foot will respond in the same manner as described above, however the extending flexor arm 10 will need to be slightly amended. For example, when the flexor 1 is to be positioned under the ball of the foot, the extending flexor arm 10 would advantageously be structured with an angle which more closely matches that of the rear support portion 11. This would lead to the upper surface of the flexor 1 being provided more level, with less of an upward extension to the extending flexor arm 10. Clearly, the ball of the foot will need to rest on the extending flexor arm 10, and so the this needs to have a rest angle which is adjusted to be more forwardly directed such that the ski boot 7 could rest thereupon. In all other aspects, however, such an "under shoe flexor" would be the same as the flexor 1 defined above for positioning near the toe of the ski boot 7. Such a flexor design can be seen in FIG. 8.

Figure 9:
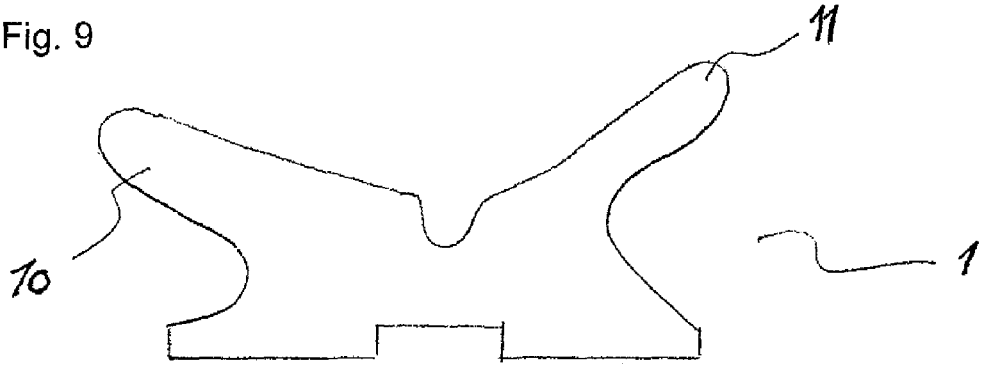
FIG. 9 shows a flexor design suitable for positioning at the heel of a boot.

Additionally, if the flexor 1 were intended to be located at the heel of the ski boot 7, it could well be structured such that the extending flexor arm 10 extended more horizontally (as described above for the under shoe flexor) than for the flexor 1 shown in the Figures. Further, if a rear support portion 11 were also incorporated within such a heel flexor, it is possible that this could extend to a less horizontal angle than as shown in the Figures. It is conceivable that the rear support portion 11 would extend upward to a greater degree than the extending flexor arm 10, and perhaps provide a heel support surface for when the skier performed a skating action. Such a flexor design can be seen in FIG. 9.

| | |
|---|---|
| 1: | Flexor |
| 2: | Ski Binding |
| 3: | Mounting Plate |
| 5: | Compression Portion |
| 6: | Rotation Pin |
| 7: | Ski Boot |
| 10: | Extending Flexor Arm |
| 11: | Rear Support Portion |
| 12: | Pin Receiving Section |
| 13: | Slot |
| 20: | Holding and Positioning Portion |
| 21: | Point of Connection |
| 22: | Feet-Like Extensions |
| 23: | Base |
| 25: | Lower Surface of Base |
| 26: | Recess |
| 30: | Linear Relationship |
| 31: | Desired Amount of Displacement |
| 32: | Approximately Exponential Relationship |
| 50: | Fixing Means |
| 51: | Shoe Attachment Means |
| 52: | Pin Receiving Section |
| 53: | Flange |
| 54: | Holding Slot |
| 55: | Binding Protrusion/Step |
| 60: | Opposed Flaps |

The invention claimed is:

1. A ski binding for a cross country or touring ski that advances in a forward direction, the ski binding comprising:

a flexor having a slot that has spaced apart forward and rearward walls for receiving therebetween a rotation pin of a ski boot, wherein the forward wall is configured to engage a front surface of the ski boot when the ski boot is attached to the ski binding and the rotation pin is received within the slot; and a shoe attachment device for removeable attachment of the ski boot, wherein the shoe attachment device is provided with a pin receiving section for receiving and holding the rotation pin of the ski boot such that a hinge action of the ski binding is provided in an interface between the binding and the ski boot; and wherein the ski binding is further structured so as to hold the flexor in a position such that the slot of the flexor is coaxially aligned with the pin receiving section such that when the rotation pin of the ski boot is held in the pin receiving section the rotation pin is also within the slot of the flexor for holding the flexor in the ski binding thereby to prevent the flexor from being lost.

2. The ski binding according to claim 1, wherein the flexor is made from two or more different materials that exhibit different wear and elastic deformation properties, thus allowing for different responses when force is applied to the flexor.

3. The ski binding according to claim 1, wherein one or more protrusions are provided to improve the connectability of the flexor with a mounting plate.

4. The ski binding according to claim 1, wherein the flexor has a base and the lower surface of the base does not form a single flat surface, such that when the flexor is in an unstressed state the entire surface of the base of the flexor does not make contact with an underlying surface, and in order to bring the lower surface of the base into full contact with the underlying surface the flexor must be stressed.

5. The ski binding according to claim 1, comprising a mounting plate, and wherein a binding protrusion or step is provided on an upper surface of the mounting plate in a region where the flexor is housed in the mounting plate, and the flexor is provided with a similarly shaped recess in a lower surface of the flexor, so that when the flexor is engaged with the mounting plate the protrusion or step is located within the recess, thus stopping the flexor from slipping forward and backward relative to the mounting plate.

6. The ski binding according to claim 5, wherein the flexor is provided with one or more indents for receiving the protrusion or step.

7. The ski binding of claim 1, wherein the flexor comprises an extending flexor arm and a holding and positioning portion, wherein the extending flexor arm is connectable to, or integral with, the holding and positioning portion such that the extending flexor arm can rotate and/or displace with respect to the holding and positioning portion around a point of connection between the two; wherein the extending flexor arm is formed such that the amount of displacement of the extending flexor arm as a result of an applied force acting thereon follows a substantially linear relationship up to a first prescribed amount of displacement, and for a displacement of the extending flexor arm greater than the first prescribed amount of displacement, the amount of displacement of the extending flexor arm as a result of an applied force acting thereon generally follows an exponential relationship.

8. A ski binding for a cross country or touring ski comprising a flexor; and a shoe attachment device for removeable attachment of a ski boot, wherein the shoe attachment device is provided with a pin receiving section for receiving and holding a rotation pin of the ski boot such that a hinge action of the ski binding is provided in an interface between the binding and the ski boot; and wherein the ski binding is further structured so as to hold the flexor in a position such that a slot of the flexor is aligned with the pin receiving section such that when the rotation pin of the ski boot is held in the pin receiving section it is also within the slot of the flexor and will thus stop the flexor from being lost; and wherein resistance means are provided that act to resist displacement of an extending flexor arm in a linear manner; and further the flexor comprises along with the flexor arm a compression portion that will act to resist the displacement of the extending flexor arm in an exponential manner, wherein the compression portion will not begin to resist the displacement of the extending flexor arm until the extending flexor arm has been displaced by a prescribed amount of displacement.

9. The ski binding according to claim 2, wherein the extending flexor arm is made from a material that can be elastically bent and compressed; and wherein a linear relationship of a force versus displacement curve relates to the force required to bend the extending flexor arm, and the exponential manner relates to a combination of the force required to bend the extending flexor arm in combination with the force required to compress the compression portion.

10. The ski binding according to claim 8, wherein the flexor further comprises a rear support portion that comprises a portion extending from a holding and positioning portion of the flexor in a direction opposite to the extending flexor arm, and that makes an angle with respect to the holding and positioning portion that is less than the angle that the extending flexor arm makes with respect to the holding and positioning portion; and the slot of the flexor is located between the extending flexor arm and the rear support portion, and wherein the slot of the flexor extends downward from the upper side of the flexor and is sized and shaped so as to allow rotation of the pin of the ski boot when the pin of the ski boot is held in the pin receiving section.

11. The ski binding according to claim 10, wherein the holding and positioning portion comprises one or more feet that provide a base for resting on the shoe attachment device, wherein the extending flexor arm makes an angle with respect to one of the feet that extends in the same direction as the extending flexor arm.

12. The ski binding according to claim 11, wherein the prescribed amount of displacement can be chosen by choosing the angle between the extending flexor arm and the one of the feet that extends in the same direction as the extending flexor arm.

13. The ski binding according to claim 10, wherein the extending flexor arm is connected in a rotational manner to a mounting plate by means of the holding and positioning portion.

14. The ski binding according to claim 10, further comprising fixing means for interacting with the holding and positioning portion of the flexor so as to removeably connect the flexor and shoe attachment device together.

15. The ski binding according to claim 10, wherein the flexor is held in position in the ski binding by at least one flange or holding slot into which a part of the holding and positioning portion can be placed.

16. A flexor for use in a ski binding or mounting plate for a cross country or touring ski comprising:

an extending flexor arm and a holding and positioning portion, wherein the extending flexor arm is connectable to, or integral with, the holding and positioning portion such that the extending flexor arm can rotate and/or displace with respect to the holding and positioning portion around the point of connection between the two;

wherein the extending flexor arm is formed such that the amount of displacement of the extending flexor arm as a result of an applied force acting thereon follows a substantially linear relationship up to a first desired amount of displacement, for a displacement of the extending flexor arm greater than the first desired amount of displacement, the amount of displacement of the extending flexor arm as a result of an applied force acting thereon follows an approximately exponential relationship;

wherein the flexor has a base and the lower surface of the base does not form a single flat surface, such that when the flexor is in an unstressed state the entire surface of the base of the flexor does not make contact with an underlying surface, and in order to bring the lower surface of the base into full contact with the underlying surface the flexor must be stressed.

17. A ski binding for a cross country or touring ski comprising a flexor, the flexor including an extending flexor arm and a holding and positioning portion, wherein the extending flexor arm is connectable to, or integral with, the holding and positioning portion such that the extending flexor arm can rotate and/or displace with respect to the holding and positioning portion around the point of connection between the two;

wherein the extending flexor arm is formed such that the amount of displacement of the extending flexor arm as a result of an applied force acting thereon follows a substantially linear relationship up to a first desired amount of displacement, for a displacement of the extending flexor arm greater than the first desired amount of displacement, the amount of displacement of the extending flexor arm as a result of an applied force acting thereon follows an approximately exponential relationship; and a mounting plate, wherein a binding protrusion or step is provided on an upper surface of the mounting plate in a region where the flexor is housed, and the flexor is provided with a similarly shaped recess in its lower surface, so that when the flexor is engaged with the mounting plate the protrusion or step is located within the recess, thus stopping the flexor from slipping forward and backward relative to the mounting plate and/or reducing stress on the holding and positioning portion from use of the ski binding.

* * * * *